United States Patent [19]

Meatheringham

[11] 4,211,017

[45] Jul. 8, 1980

[54] FOOTBALL TRAINING AID

[76] Inventor: Michael R. Meatheringham, 955 Stovall Blvd., N.E., Atlanta, Ga. 30319

[21] Appl. No.: 961,278

[22] Filed: Nov. 16, 1978

[51] Int. Cl.[2] ..... A63B 69/00

[52] U.S. Cl. ..... 35/29 R; 273/DIG. 30

[58] Field of Search ..... 35/7 R, 29 R, 29 C; 273/DIG. 30, 95 R; 24/204

[56] References Cited

U.S. PATENT DOCUMENTS

| | | | |
|---|---|---|---|
| 2,458,984 | 1/1949 | Engle | 35/29 R |
| 3,277,589 | 10/1966 | Berdan | 35/7 R X |
| 3,327,419 | 6/1967 | Stanos | 24/204 X |
| 3,601,917 | 8/1971 | Shankman | 24/204 X |
| 3,941,382 | 3/1976 | Clark | 273/95 R |
| 4,047,308 | 9/1977 | Wheeler | 35/29 R |

*Primary Examiner*—Harland S. Skogouist

*Attorney, Agent, or Firm*—Birch, Stewart, Kolasch & Birch

[57] ABSTRACT

A training aid designed to be used to instruct individuals in the proper technique of playing the game of football is described. The training aid includes an elongated strip of flexible material which is lined along both edges with strips of Velcro. In addition, the training aid includes a plurality of player position mats and play mats which are lined along one edge with a strip of Velcro. The elongated strip of flexible material represents the line-of-scrimmage and is positioned across a playing field or other suitable playing surface. The plurality of player position mats and play mats may be exactly positioned adjacent the line-of-scrimmage and may be removably affixed thereto by means of the respective Velcro edges.

6 Claims, 3 Drawing Figures

FOOTBALL TRAINING AID

BACKGROUND OF THE INVENTION

1. Field of the Invention

The present application is directed to a football training aid which is utilized to instruct individuals in the proper techniques employed in the game of football. The present application discloses an elongated flexible strip of material which is lined along each edge with a strip of Velcro and which has applied thereto a plurality of player position mats and a plurality of play mats which include a strip of Velcro so as to removably affix the plurality of player position mats and the plurality of play mats to the elongated strip of flexible material.

2. Prior Art

Heretofore, to train an individual in the proper techniques employed in the game of football, it has been customary to provide instruction by positioning a number of individuals at the various positions along a line-of-scrimmage and assigning positions to each individual. For example, on the offense an individual would be designated as the center, two individuals would be designated as the guards, two individuals would be designated as the tackles, two individuals would be designated as the ends, an individual would be designated as the quarterback, two individuals would be designated as the halfbacks, and an individual would be designated as the fullback. Similarly, on the defense individuals would be given positions as the defensive line, the linebackers, and the defensive backfield. Thus, to properly instruct an individual in the techniques involved with the game of football, it has hithertofore been necessary to have at least twenty-two players or individuals who may be assigned the various positions so that each individual knows exactly where he or she should be positioned relative to the other players.

This traditional approach utilized in instructing an individual in the proper techniques in playing the game of football has a number of deficiencies which are readily overcome by the subject matter of the present invention. Namely, when a plurality of individuals are positioned on a playing field each being designated with a different position it is difficult for a novice in the game of football to remember exactly which position the other individuals have been assigned. More particularly, it is extremely difficult for the novice quarterback, halfbacks or fullback to remember exactly where he should move when a particular play is called. Therefore, if the quarterback decides that the left halfback should carry the ball between the left guard and the left tackle it is sometimes difficult for the novice left halfback to remember exactly where the left guard and left tackle is positioned. Thus, confusion often arises and the individual who is attempting to learn the game of football becomes frustrated and disappointed.

A number of prior art devices have been developed to facilitate the instruction of an individual in the game of football. One prior art device, U.S. Pat. No. 2,458,984 issued to C. A. Engle, was designed to accurately carry out the movement of the backs in the backfield without the necessity of occupying the time of the linemen. The device disclosed in the Engle patent consists of a strip of material containing only the designation of the offensive line members. The strip of flexible material may be a continuous strip with the appropriate designation of the offensive or may be a strip consisting of a plurality of sections that may be snapped together to indicate a balanced or unbalanced offensive line. The football instructing device of the Engle patent does not include any means for attaching a plurality of player position mats nor does it disclose any means for identifying the position of the defensive players. Further, the football instructing device of the Engle patent contains no disclosure relating to identifying a particular play which would be carried through a particular hole in the offensive line.

A number of prior art devices have been developed to facilitate the teaching of the game of football in a classroom or adjacent a playing surface. These prior art devices consist mainly of a board which may be positioned either horizontally or vertically and upon which are positioned a plurality of models which depict the various positions of the individual players. A representative sample of devices which employ a board on which a plurality of players are positioned is disclosed by the following patents: U.S. Pat. No. 2,158,368 issued to V. C. Hurt; U.S. Pat. No. 2,579,105 issued to J. J. Baldine; U.S. Pat. No. 2,643,466 issued to R. S. Bucher; and U.S. Pat. No. 2,946,134 issued to R. D. Neilson.

Although the patents listed above disclose devices used in instructing individuals in the correct techniques employed in the game of football, they do not disclose nor suggest the training aid of the present invention.

SUMMARY OF THE INVENTION

It is an object of the present invention to provide an improved football training aid which is greatly simplified from the training aids disclosed in the prior art.

It is an object of the present invention to provide a training aid which clearly depicts the exact position of both the offensive and defensive players and also depicts a plurality of plays which correspond to holes in the offensive line.

It is an object of the present invention to provide a training aid which enables a novice football player to understand the positioning of the other players and to readily identify various plays.

Another object of the present invention is to eliminate the need of the linemen to stand in their various positions as the backs practice a variety of different plays.

A still further object of the present invention is to provide an elongated flexible strip which has attached thereto the offensive players on one side thereof and the defensive players on the other side thereof and to provide arrows or markers to indicate which defensive player an offensive player is to block.

These and other objects of the present invention are fulfilled by constructing an elongated flexible strip of material which represents the line-of-scrimmage and to position Velcro along each edge thereof. A plurality of player position mats are designed to include Velcro along one edge thereof and may be removably fastened to the elongated strip of flexible material. In addition, a plurality of play mats including a strip of Velcro along one edge thereof may be removably secured to the elongated strip of flexible material to identify a plurality of plays. Thus, the present invention identifies not only the offensive players and a plurality of offensive plays but is also designed to identify the exact position of the defensive players.

Other objects and further scope of applicability of the present invention will become apparent from the detailed description given hereinafter. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
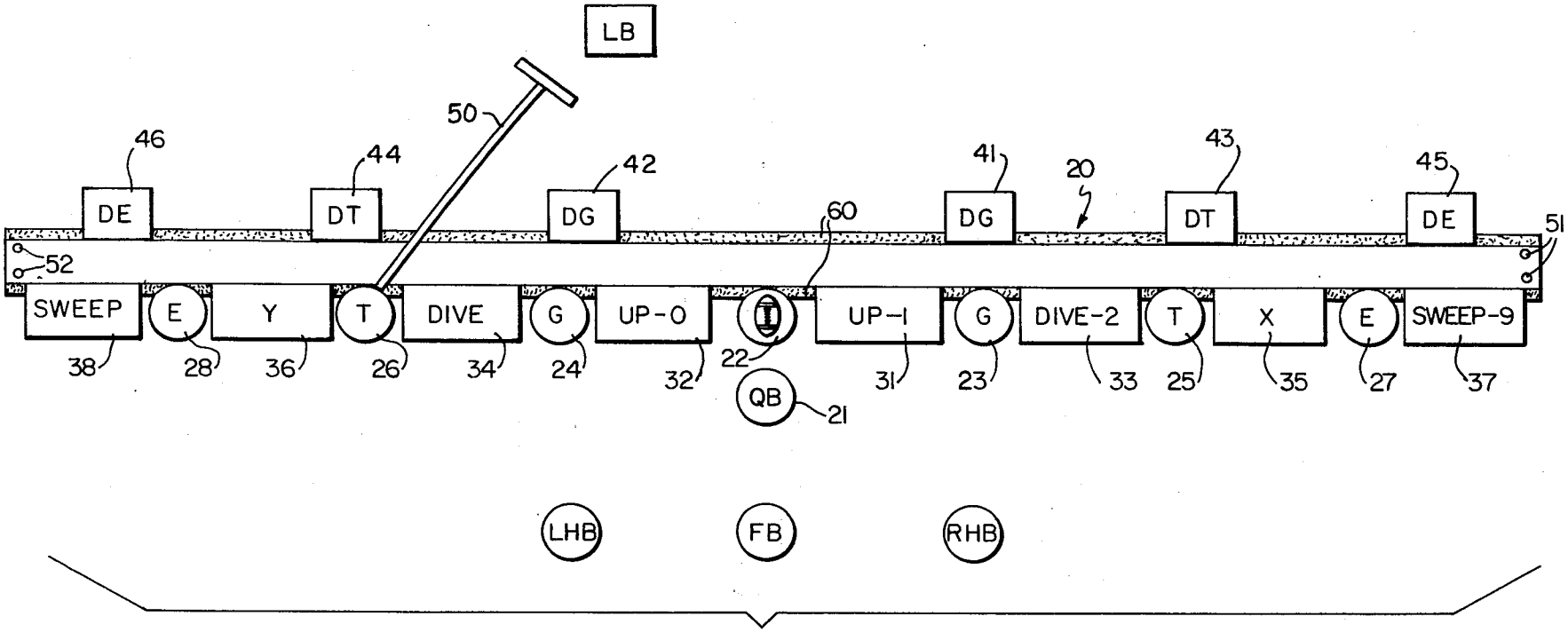
FIG. 1 is a perspective view of the football training aid of the present invention.

Referring in detail to FIG. 1, there is illustrated a football training aid generally indicated by 20, which includes a plurality of player mats and play mats attached thereto. The elongated flexible football training aid 20 includes two strips 60 made of Velcro which are positioned along each edge thereof.

The player mats indicated by circles on the offensive side of the line-of-scrimmage include large letters attached thereto which represent the first letter of each of the individual football players. For example, the circular player mats with the letter "G" represent the exact positioning of the offensive guards; the player mats with the letter "T" indicate the exact positioning of the offensive tackles and the circular player mats with the letter "E" represent the exact positioning of the offensive ends. The positioning of each of the players on the offensive side of the line-of-scrimmage may be adjusted to a location which represents the exact position of the particular players after a particular offensive line formation is selected.

The football training aid as shown in FIG. 1 depicts a balanced line wherein the quarterback is adjacent the center which is shown by a circular player mat with a football positioned thereon and the line is balanced to include an equal number of players on each side of the center. Thus, as shown in FIG. 1 the balanced line depicts a guard 23, tackle 25, and an end 27 positioned to the right of the center and a guard 24, tackle 26, and an end 28 positioned to the left of the center. Each player mat is firmly secured to the football training aid 20 by a strip of Velcro positioned along one edge thereof which is attached to the strip of Velcro 60 on the football training aid. If it is desired to depict an unbalanced line, one would merely remove the player mat from the one side of the line to the side of the line which is to be unbalanced.

FIG. 1 discloses a plurality of play mats which are securely affixed to the football training aid 20 and which identify the exact hole of a particular play. For example, the play UP-1 requires a back to run between the center and the right guard; the play UP-0 requires a back to run between the center and the left guard. Play mats 31, 33, 35 and 37 identify the exact location through which a back is required to run in order to complete a particular play on the right side of the line. The play mats 32, 34, 36 and 38 identify the exact location through which a back is required to run to complete a particular play on the left side of the line.

By positioning the football training aid 20 across a playing field or other playing surface and attaching it thereto by means of downwardly projecting pins 51 and 52, an instructor may position the various players on the offensive side of the football training aid and identify each particular hole through which a play is to be carried out. The attachment of the player mats and the play mats is readily accomplished by utilizing a strip of Velcro 60 along each side of the football training aid 20. Player mats may readily be adjusted and play mats may readily be changed to provide for various offensive formations and various plays which the instructor wishes to utilize.

As shown in FIG. 1, the circular player mats with the letters LHB, FB, and RHB depict the position of the backfield. The offensive backfield, including the quarterback, may use the football training aid 20 as a means of identifying exactly where the players and plays are located so that they can conduct a practice session without employing additional individuals to stand in the position of the various offensive line players. Thus, the football training aid 20 of the present invention permits the four members of the backfield to practice various plays and running techniques without occupying the time of the offensive line players. Therefore, the offensive line players may conduct a separate training session designed to enhance their particular playing techniques.

The defensive side of the football training aid 20 also includes a strip of Velcro 60 positioned along the edge of the football training aid. The defensive player mats 41, 43 and 45 represent the left side of the defensive line. The defensive player mats 42, 44 and 46 represent the right side of the defensive line. The player mat with the letters LB depicts a linebacker. Referring to FIG. 1, the left tackle 26 on the offensive side of the football training aid 20 is shown to have an instructional arrow 50 positioned adjacent the player mat 26. This instructional arrow 50 indicates the exact direction in which the offensive left tackle is to position himself on a particular play. As shown in FIG. 1, the offensive left tackle indicated by the player mat 26 is required to block the linebacker LB on the particular play that is being carried out.

It should be noted that the lettering on the player mats representing the defensive players are shown in FIG. 1 as being rotated 180° from the normal position that the letters would occupy when using the football training aid 20 of the present invention. Depicting the lettering of the defensive players in this manner is only for the purpose of clarity. However, it may be desirable under certain circumstances to use the football training aid 20 exactly as shown in FIG. 1 for the purpose of instructing an individual in the proper techniques employed in the game of football.

Figure 2:
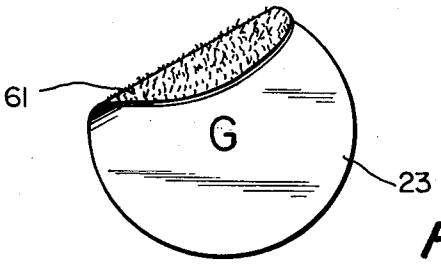
FIG. 2 illustrates a player mat with a portion thereof curled over to show the Velcro portion.

FIG. 2 illustrates a player mat 23 which includes thereon the letter "G". The upper portion of the player mat 23 is curled backwards to reveal a strip of Velcro 61. Each player mat includes a strip of Velcro similar to that as shown in FIG. 2 which enables the player mat to be removably fastened to the strip of Velcro 60 positioned on the football training aid 20.

It is to be understood that the player mats 23 and 24 are identical to each other and may be interchanged when utilizing the football training aid 20 of the present invention. Similarly, the player mats 25, 26, 27 and 28 are identical to each other. In other words, the offensive left guard, tackle and end player mats may be interchanged to represent the offensive right guard, tackle and end player mats, respectively.

Figure 3:
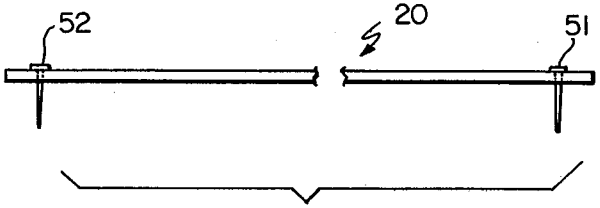
FIG. 3 is a side view of the football training aid of the present invention.

FIG. 3 illustrates a side view of the football training aid 20 of the present invention. As previously discussed, the football training aid 20 may be positioned on a playing field or any suitable playing surface. Although it may not always be necessary, the climatic conditions may require that the football training aid 20 be securely affixed to the playing surface by means of downwardly projecting pins 51 and 52. As shown in FIG. 3, the downwardly projecting pins 51 and 52 merely secure the end portion of the football training aid 20 to the playing surface.

Through the specification particular reference has been made to the use of Velcro to removably secure the player mats and the play mats to the elongated strip of flexible material. It is to be understood that any suitable means of removably attaching the player mats and play mats to the elongated strip may be utilized in accordance with the concept of the present invention.

The invention being thus described, it will be obvious that the same may be varied in many ways. Such variations are not to be regarded as a departure from the spirit and scope of the invention and all such modification as would be obvious to one skilled in the art are intended to be included in the scope of the following claims.

It is claimed:

1. A device for instructing the playing of football comprising:

an elongated strip of material which represents the line-of-scrimmage and includes first securing means along at least a portion thereof;

a plurality of player mats which indicate the particular offensive and defensive players and which include second securing means along at least a portion thereof;

said material representing a line-of-scrimmage being adapted to removably secure the plurality of player mats by interreaction of the first and second securing means; and said defensive and offensive player mats being readily adjustable relative to the material representing the line-of-scrimmage to indicate a plurality of offensive and defensive formations.

2. A device for instructing the playing of football according to claim 1, wherein the material representing the line-of-scrimmage includes at least one opening at the ends thereof adapted to receive a pin for securing the material to a playing surface.

3. A device for instructing the playing of football according to claim 1, wherein an instructional arrow may be positioned on the material representing the line-of-scrimmage to indicate the exact direction an offensive or defensive player is to position himself on any particular play.

4. A device for instructing the playing of football according to claim 1, wherein said first and second securing means are Velcro fasteners.

5. A device for instructing the playing of football according to claim 1, wherein the device includes a plurality of play mats which depict various defensive and offensive plays and which includes third securing means along at least a portion thereof.

6. A device for instructing the playing of football according to claim 5, wherein said third securing means along at least a portion of the plurality of play mats is Velcro.

* * * * *